US006135366A

United States Patent [19]

Bodelin et al.

[11] Patent Number: 6,135,366

[45] Date of Patent: Oct. 24, 2000

[54] INJECTOR OF FUEL IN THE FORM OF A MIST FOR AN OIL BURNER, AND BURNER EQUIPPED WITH SUCH AN INJECTOR

[75] Inventors: Pierre Bodelin, Vanves; Bernard Labegorre, Paris; Patrick Recourt, Marcoussis, all of France

[73] Assignee: L'Air Liquide, Societe Anonyme pour l'Etude et l'Exploitation des Procedes Georges Claude, Paris, France

[21] Appl. No.: 09/329,993

[22] Filed: Jun. 10, 1999

[30] Foreign Application Priority Data

Jun. 15, 1998 [FR] France ..... 98 07499

[51] Int. Cl.[7] ..... F23D 11/10

[52] U.S. Cl. ..... 239/423; 239/590

[58] Field of Search ..... 239/296, 423, 239/424, 589, 590, 602, 584

[56] References Cited

U.S. PATENT DOCUMENTS

| | | | |
|---|---|---|---|
| 1,279,315 | 9/1918 | Foerts | 239/590 |
| 3,314,612 | 4/1967 | Anthes et al. | 239/590 |
| 4,203,717 | 5/1980 | Facco et al. | 239/404 |
| 5,944,507 | 8/1999 | Feldermann | 239/424 |

FOREIGN PATENT DOCUMENTS

| | | | |
|---|---|---|---|
| 0 392 553 A1 | 10/1990 | European Pat. Off. . | |
| 0 646 751 A1 | 4/1995 | European Pat. Off. . | |
| 0 755 720 A1 | 1/1997 | European Pat. Off. | 239/590 |
| 2 377 576 | 8/1978 | France . | |
| 2637-050 | 3/1990 | France | 239/590 |
| 2 096 911 | 10/1982 | United Kingdom . | |

*Primary Examiner*—Andres Kashnikow
*Assistant Examiner*—Jorge Bocanegra
*Attorney, Agent, or Firm*—Burns, Doane, Swecker & Mathis, L.L.P.

[57] ABSTRACT

The injector comprises a duct (31) through which a liquid fuel which forms a film lining its wall, and an atomizing fluid, are transmitted to its downstream part, from where the fuel is sprayed, forming a mist with the atomizing fluid.

The downstream part has, from the duct (31) towards the free end of the injector, a chamber (32) for destabilizing the film which has a cross section that is larger than that of the duct, a throat (33) for detaching the film extending the destabilization chamber and having a cross section that is smaller than that of this chamber, and a spray orifice (34) which is open at the end of the injector, into which the throat opens, and which has a larger cross section.

Use: heating furnaces, especially glass furnaces.

12 Claims, 3 Drawing Sheets

INJECTOR OF FUEL IN THE FORM OF A MIST FOR AN OIL BURNER, AND BURNER EQUIPPED WITH SUCH AN INJECTOR

BACKGROUND OF THE INVENTION

1. Field of the Invention

The invention relates to injectors of fuel in the form of a mist (known in the art by the name of spray), for oil burners comprising a tube through which coaxial ducts pass, one of which tubes conveys an atomizing fluid and another a liquid fuel, which are then transmitted to this injector. It also relates to burners equipped with such an injector.

2. Description of the Related Art

A wide variety of atomizing or liquid-atomizing devices are known which coaxially comprise a certain number of ducts for conveying one or more liquids to be atomized and one or more atomizing gases under pressure to an outlet orifice for the atomized product.

In effect, means designed to atomize a given liquid under optimum conditions do not necessarily yield the best results for another liquid which has different physical properties, and furthermore, the desired composition of the mist varies from one application to another.

For example, U.S. Pat. Nos. 2,565,696, 3,035,775, 3,533,558, 3,662,960 and 3,805,869 disclose devices intended respectively for spraying concrete, for spraying the components of a polyurethane foam, for atomizing highly viscous starch solutions, for injecting liquid fuels for rocket motors, and for atomizing polyvinyl chloride solutions in a dry atmosphere with a view to converting them into powder; these devices have highly diverse structures so that the flows through the ducts can present specific patterns, for example helical in the case of document U.S. Pat. No. 3,533,559, so as to bring the various components into each other's presence in an optimum way immediately before or at the time that they exit the device.

However, the atomization of liquid fuels in burners also poses specific problems such as those of avoiding flashback and coking of the outlet injector, which means that it is impossible for devices from other fields to be applied directly or simply adapted that it has long been sought to solve using appropriate means.

For example, U.S. Pat. No. 792,265 discloses a burner which coaxially comprises a central duct through which a liquid fuel flows, and two annular ducts through which a stream of pressurized vapour flows, these ducts being fed in their upstream region respectively with the liquid to be sprayed and with the vapour; the free (downstream) end of the first annular partition which is common to the central duct and to the immediately adjacent annular duct is very much upstream of the free (downstream) end of the second annular partition; thus, initial external atomization of the liquid fuel is achieved when the jet of liquid is sheared from the outside by the vapour arising in an annulus around this jet at the nozzle-forming free end of the first annular partition; the second annular partition delimits internally, starting from this free end, another central duct through which the stream resulting from the first atomization passes; this stream is subjected to a second external atomization at the free ends, located in the same transverse plane, of the two nozzle-forming partitions of the second annular duct. With this structure, it is highly difficult to obtain a mist with precise characteristics.

U.S. Pat. No. 1,279,315 discloses a burner of a similar structure but in which the first annular duct has a stream of air passing through it while the second annular duct has a stream of air or vapour passing through it, with the same drawbacks as those mentioned earlier.

It was thought that by conveying a liquid fluid to be atomized in an annulus around a first, gaseous, atomizing fluid, the atomization process could be better controlled.

Thus, there are also known liquid-atomization devices which comprise, coaxially, from the inside towards the outside, a central duct through which an atomization gas passes, an annular duct through which the product to be atomized passes in the liquid state, and an annular duct through which an atomization gas also passes, these ducts being fed, in a first end region (upstream region) with the atomization fluid and fluid to be sprayed, and comprising respective nozzles in the second end region (downstream region) for spraying the product which was initially in the liquid state, in the form of droplets in suspension in the atomizing fluids.

This is the case in particular for the subjects of documents GB 672,441, EP 0,105,493 and EP 0,593,171, but here too, the prior art is not entirely satisfactory for atomizing a liquid fuel in the charging opening of a furnace.

The problem is that in these three documents the respective downstream ends at least of the two annular ducts end in a nozzle, in which the downstream end of the central duct, which is set back slightly inside the intermediate annular duct, is nonetheless very close; what this means is that although the product in the liquid state that is to be atomized is transmitted through the intermediate annular duct, the atomization caused by the internal atomization gas can be likened to external atomization (it results from the shearing of the jet of liquid by the angular end of the exterior wall of the annular duct for the liquid); the atomization caused by the external atomization gas is naturally also external atomization, and thus these devices may be considered as being devices with two stages of external atomization. In consequence, fine control of the state of atomization of the mist (mean diameter of the droplets and proportion of small droplets) is therefore very tricky.

What this means is that despite the existence of the devices in these three documents, there was still the need to create a device which, on the one hand, could bring about internal atomization and, on the other hand, could bring about external atomization of the liquid to be sprayed.

To this end, in a known type of oil burner comprising an atomization device according to patent document FR 2,737,138, there is provided a tube comprising an inlet part comprising coaxially, from a central duct for a fluid for the "internal" atomization of the oil, and an annular duct for the oil, and an annular duct for a fluid for "external" atomization; between the exterior wall of the tube and the partition of the burner is defined an additional annular duct conveying an oxidizing gas. In the outlet part of the tube but markedly upstream of its outlet end, the central duct for the internal atomization fluid terminates in an "internal" injector opening into the duct for the oil and thus forming, downstream of the internal injector, a central confinement duct constituting a preatomization space for the internal atomization fluid and the oil, surrounded by the annular duct for the external atomization fluid, while the duct for the oxidizing gas remains between the exterior wall of the tube and the partition of the burner.

All or some of the preatomization space may be produced in a component in the form of a "mixture" injector through which the oil atomized by the internal atomization fluid is injected into the charging opening of the burner, and around which the external atomization fluid is injected.

The invention relates more specifically to such a fuel mixture injector through which an internal atomization fluid and the actual fuel (liquid) pass, and therefore aims to create an injector of fuel mist which makes it possible to improve the quality of atomization on the one hand, while at the same time avoiding the presence of "grains" within the flame produced by the burner, the term "grains" denoting fuel droplets which are large enough to remain individually clearly visible as they burn within the flame, and on the other hand while at the same time increasing the flame stability, attachment of the flame at the tip of the burner being made almost systematic.

It might be hoped that this objective could be achieved by reducing the mean time needed to evaporate the population of droplets, by increasing the proportion by mass of small droplets (diameter smaller than 20 $\mu$m) within the mist and by decreasing the mean diameter of all the droplets (for constant atomization fluid and liquid fuel flow rates).

In point of fact, in the mixture injector of the device known from document FR 2,737,138, which may be laid out as depicted in FIG. 1, the longitudinal central confinement duct constituting the preatomization space has two regions 11, 12 of different diameters connected frustoconically in a zone 13, the region 11 of larger diameter constituting the inlet region of the injector and the region 12 of smaller diameter its outlet region.

In general, the ratio of the length of the region 12 to its diameter is of the order of 8 to 12 and typically equal to approximately 9.

In this injector of fuel mixture in the form of a mist, it may be observed that a film 21 of liquid fuel of approximately constant thickness is formed along the entire length of the large-diameter region 11 of the central duct, this film 21 being connected to a film 22 extending along the small-diameter region by a frustoconical zone 23; however, the internally frustoconical shape of the film extends beyond the frustoconical connection between the two cylindrical regions of the duct, and leads to the formation of an increased thickness of the film in the small-diameter region, the thickness of the film 22 in this region then decreasing as far as the free end of the injector.

It would seem that under these conditions, the atomization of the liquid fuel results from the detachment of the film which lines the wall of the duct of the injector, which is something which, on the one hand, produces relatively large droplets and, on the other hand, rapidly entrains the small droplets into the stream of atomization fluid (for example air) travelling at high speed, and this limits the amount of fuel evaporated locally and does not allow good combustion of the heavy fuel oil.

The object of the invention is therefore to overcome these drawbacks by increasing the proportion by mass of small droplets and by decreasing the mean diameter of the droplets and the speed of the small droplets, and also to improve the stability of the flame inside and outside the burner charging opening through the adoption of an appropriate geometry for the injector, or at least for the downstream part thereof which terminates at its free end.

SUMMARY OF THE INVENTION

To this end, the invention relates to a fuel injector, especially for an oil burner, internally comprising a duct through which a fuel in the liquid state at least partially in the form of a film lining the internal wall of the duct and an atomizing fluid are transmitted to the downstream part of the injector which terminates at the free end thereof through which the fuel is sprayed from the injector forming a mist with the stream of atomizing fluid, characterized in that this downstream part has internally, in longitudinal alignment with the duct, and in succession towards the free end, a chamber for destabilizing the film which has a cross section that is larger than that of the duct, a throat for detaching the film extending the destabilization chamber and having a cross section that is smaller than that of this chamber, and a spray orifice which is open at the free end of the injector, into which the detachment throat opens, and which has a cross section that is larger than that of the throat.

By virtue of this configuration, the film of liquid film is detached from the wall of the duct more readily than in the fuel mixture injectors of the prior art, once it has entered the throat provided for this purpose, and this means that finer droplets are formed and in greater quantity.

The injector according to the invention may additionally exhibit one or more of the following features:

- the detachment throat has a cross section that is smaller than that of the duct;
- the destabilization chamber has a circular cross section, the diameter of which is greater approximately by half than the diameter of the duct, which is also of circular cross section;
- the destabilization chamber has a circular cross section, and its length is approximately three times its diameter;
- the detachment throat has a circular cross section, and its length is smaller than its diameter;
- the detachment throat has a circular cross section, and its length is greater than one quarter of its diameter;
- the spray orifice has a circular cross section, and its length is at most equal to the diameter of the throat;
- the spray orifice has a circular cross section, and its length is at least equal to half the diameter of the throat;
- the spray orifice has a circular cross section, and its diameter is greater approximately by half than the diameter of the detachment throat, which is also of circular cross section;
- the spray orifice is surrounded by an annular partition, the outside diameter of which is approximately 1 mm greater than the inside diameter;
- the said downstream part is made of metal;
- it is entirely made of metal.

The invention also relates to a burner of the type comprising a tube, a downstream end of which is designed to bear a mixture injector as mentioned hereinabove and an external injector, characterized in that the tube internally has a screwthread into which the mixture injector is screwed and externally has a screwthread around which the external injector is screwed and comprises an annular duct extended by a space determined between the external injector and the mixture injector.

By virtue of this structure, the injector according to the invention can be fitted to a burner, whether this be as "original equipment" or as a replacement for an injector of the prior art, simply and quickly.

The burner according to the invention may additionally exhibit one or more of the following features:

- the free ends of the two injectors open into the same plane;
- it comprises a body which externally has a flange for fixing it to a charging unit, and a flange for connection to a flange of the tube;
- it comprises a body which externally has clevis blocks each comprising a pivot about which is articulated a threaded shank designed to be housed in corresponding facing cut-outs in the peripheral region of two flanges borne respectively by the body of the burner and by the tube right through which it passes, and which is locked by a nut.

BRIEF DESCRIPTION OF THE FIGURES OF THE DRAWING

Other features and advantages of the invention will emerge from the description which will follow of one embodiment of the invention given by way of non-limiting example and illustrated by the appended drawings, in which.

DETAILED DESCRIPTION OF THE PREFERRED EMBODIMENTS

Figure 1:
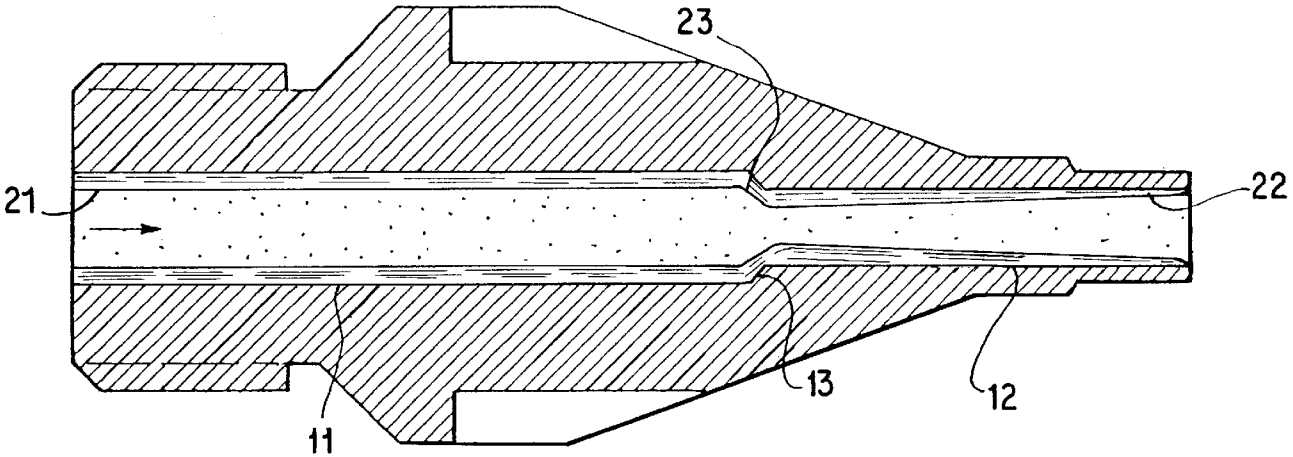
FIG. 1 PRIOR ART
FIG. 1 is a diagrammatic longitudinal section through an injector according to the prior art.
Figure 2:
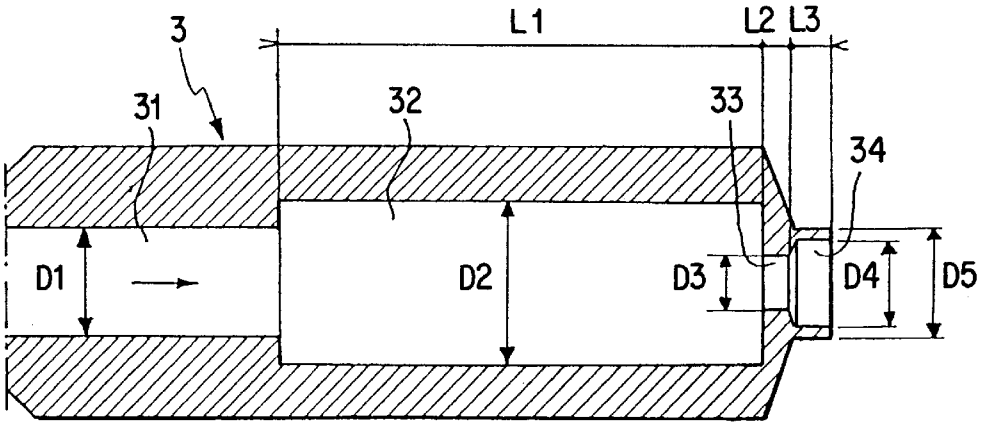
FIG. 2 is a diagrammatic longitudinal section through the downstream part of an injector according to the invention.

The fuel mixture injector 3, especially for an oil burner, the downstream part of which is depicted in FIG. 2, may be made of a single piece or alternatively be formed of several distinct pieces one of which consists, for example, mainly of the downstream part of this figure.

This injector internally comprises a cylindrical duct 31 through which a fuel in the liquid state and an atomization fluid are transmitted to its downstream free end in such a way that the fuel is sprayed, forming a mist with the stream of atomization fluid.

In its downstream part, the injector internally has, longitudinally aligned with the duct 31 and in succession towards the free end of this part, a chamber 32 for destabilizing the film with a cross section larger than that of the duct, a throat 33 for detaching the film extending the destabilization chamber and having a cross section smaller than that of this chamber and than that of the duct, and a spray orifice 34 which,is open at the free end of the injector, into which the detachment throat opens, and which has a cross section greater than that of the throat.

The chamber 32 connects to the duct 31 and to the throat 33 by way of shoulders which define surfaces that are perpendicular to the direction of flow shown by an arrow in the figures; by contrast, the throat 33 and the orifice 34 connect frustoconically, the connection cone frustum having a very obtuse angle at the vertex.

The thickness of the partition surrounding the spray orifice 34 is small, as will be seen later, so as to avoid the risks of coking at the end of the injector.

Thus, like in known injectors, the fuel in the liquid state travels through the duct 31 at least partially in the form of a film lining the interior wall of the duct.

However, it is by means of the chamber 32 that the duct 31 is connected to the film detachment region consisting of the throat 33 which presents an obstacle to the flow and thus encourages the film of liquid fuel to be broken up by the stream of gaseous atomization fluid.

The attachment of the film to the interior wall of the injector is destabilized by virtue of the chamber 32, the abrupt variations in cross section manifested by the presence of the shoulders, the surface of which extends at right angles to the direction of flow facilitating the detachment and atomization which then occur at the throat 33. Also, the chamber 32 which has a larger diameter than the duct 31 decreases the speed of the small droplets transported by the atomization air, the inertial effect of which is negligible as a consequence of their low mass.

In order to avoid any coalescence of the droplets formed, the length of the throat is relatively small compared with its diameter.

The mist that results from the atomization is then guided to the spray orifice 34, which must not be too long, also for the reason of avoiding coalescence of the droplets, but must, however, be long enough to allow the mist to return to a steady flow.

As has been seen, the small thickness of the partition surrounding the spray orifice 34 makes it possible to prevent the risk of coking at the end of the injector, by reducing the area exposed to the radiation of the furnace.

By contrast, for reasons of mechanical strength, the thickness in the other regions is greater, and this downstream part externally has a cylindrical overall shape connecting frustoconically to the region surrounding the orifice 34.

In the example depicted in FIG. 2, the duct 31, the destabilization chamber 32, the detachment throat 33 and the spray orifice 34 have a circular right cross section.

Optimized operation of this downstream part is associated with a certain geometry and more specifically with the existence of the following dimensional relationships, in which:

D1 is the diameter of the duct 31,

D2 and L1 are respectively the diameter and the length of the chamber 32 for destabilizing the film, D3 and L2 are respectively the diameter and the length of the throat 33 for detaching the film, D4 and L3 are respectively the diameter and the length of the spray orifice 34, D5 is the outside diameter of the partition surrounding the spray orifice 34:

$$D2/D1 \approx 1.5 \text{ and } L1 \approx 3D2;$$

$$0.25 < L2/D3 < 1$$

$$1 < D3/L3 < 2 \text{ and } D4/D3 \approx 1.5.$$

Finally, D5−D4, as has been seen, must be small, but for reasons of mechanical strength, D5−D4≈1 mm is adopted.

As a preference, at least this downstream part of the injector is made of metal, for reasons of mechanical strength and ability to withstand temperature.

Figure 3:
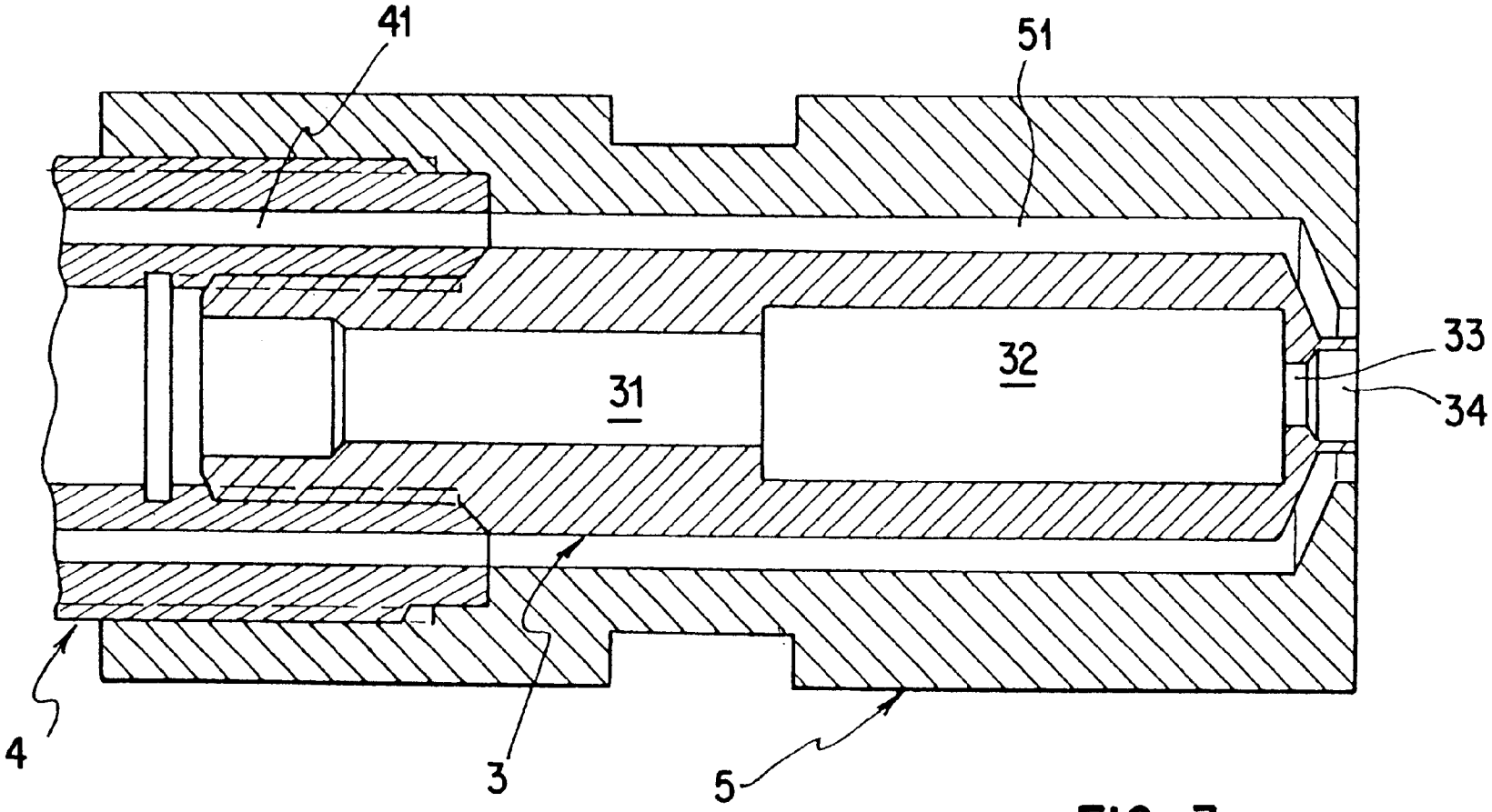
FIG. 3 is a diagrammatic longitudinal section showing the downstream part of an atomization tube equipped with an injector according to the invention.
Figure 4:
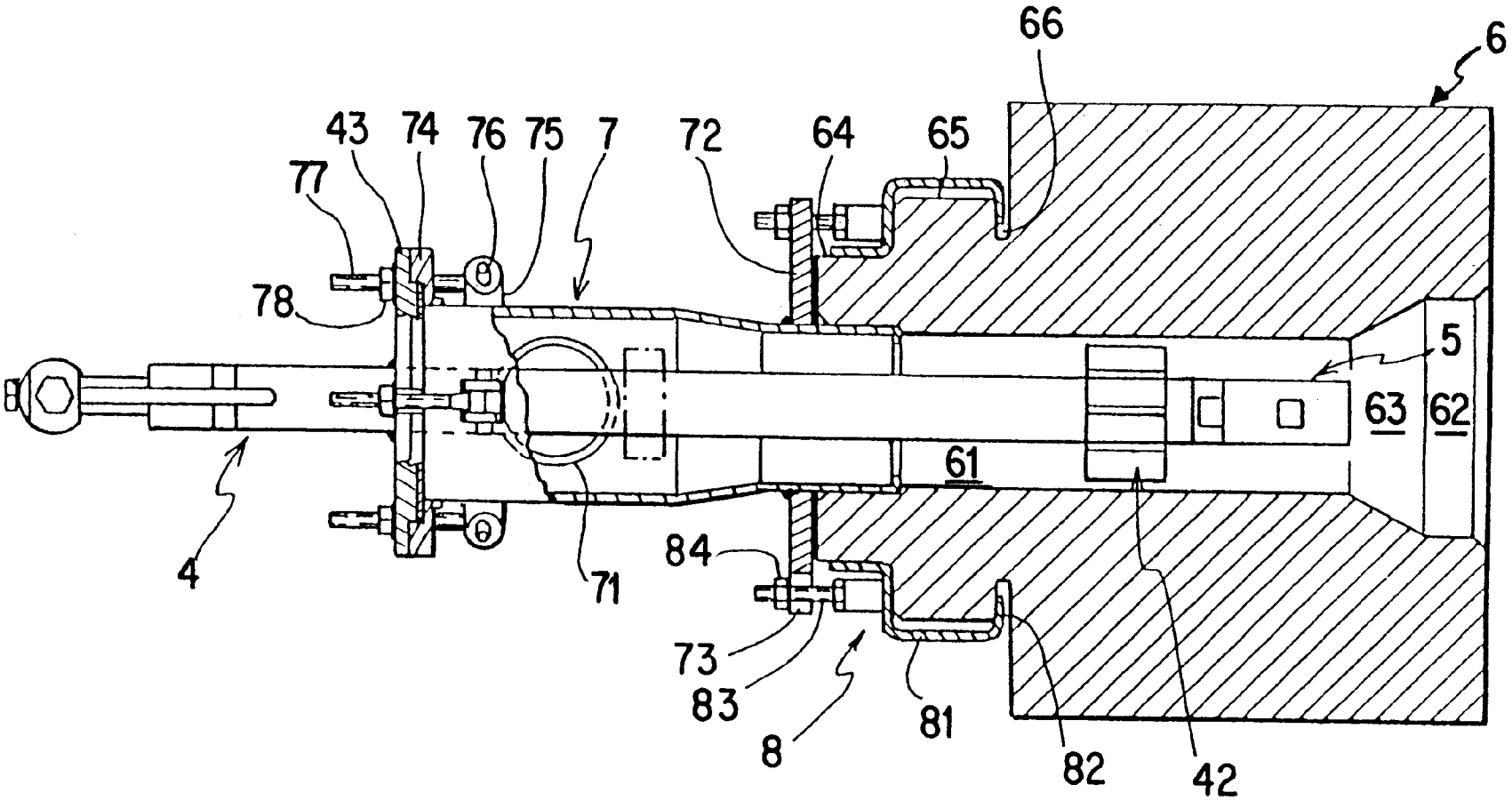
FIG. 4 diagrammatically shows the mounting of a burner comprising such a tube according to the invention on a charging unit of a furnace, for example a glass melting furnace.

The injector which has just been described is intended to be fitted to a burner comprising a tube 4 of which the downstream end bearing the injector and opening into the charging unit of a furnace is depicted diagrammatically in FIG. 3, the way in which the burner according to the invention is mounted with respect to the charging unit being itself depicted diagrammatically in FIG. 4.

The downstream end of the tube 4 externally comprises a screwthread about which an external injector 5 is screwed, and internally comprises a screwthread into which the mixture injector 3 just described is screwed. The annular space 51 determined between the external injector and the mixture injector, in the extension of an annular duct 41 of the tube for the external atomization fluid, closely follows the contour of the mixture injector as far as the respective free ends of the two injectors 3, 5 which open in the same plane; by contrast, the internal injector through which the internal atomization fluid is introduced into the stream of fuel is set back into the tube 4, upstream of the mixture injector.

The charging unit 6 into which the tube 4 which passes from upstream to downstream through the burner body 7 is introduced internally comprises two regions, an upstream region 61 and a downstream region 62, respectively, which open respectively to the outside and to the inside of the furnace, of cylindrical overall shape, connected by a frustoconical intermediate region 63. More specifically, the downstream cylindrical region 62, of larger diameter, opens into the furnace, flaring slightly, and the upstream region 62 comprises a shoulder for positioning the exterior wall of the body of the burner 7 in abutment.

The tube 4 is positioned in the charging unit in such a way that between its exterior wall and the interior wall of the unit is defined an annular duct for the oxidizing agent and that the free end of the external injector 5 is in the vicinity of the downstream end of the upstream region 61 which connects with the frustoconical region 63. The tube is centered in the upstream region 61 by way of a ring 42 fixed around the tube, and which naturally has passages extending in the upstream to downstream direction for the oxidizing agent. The oxidizing agent is conveyed into the body of the burner 7 by a lateral pipe 71 which opens into the upstream region thereof.

Externally and on the upstream side, the charging unit has a region for the attachment of the burner in the form of a projection with opposed walls with shoulders 64, 65, the upper shoulder 65 of which is connected to the body of the charging unit via a cut 66; the body of the burner has an external flange 72, and the burner is attached removably to the charging opening by means of a device 8 comprising attachment elements 81 made of bent metal sheet which approximately follows the shape of the shoulders; these attachment elements have an end lip 82 inserted in the cut 66, and are fitted with threaded components 83 designed to be housed in cut-outs 73 extending in the peripheral region of the flange 72 right through which they pass and which are locked by nuts 84.

The body of the burner 7 and the tube 4 are fixed together at respective flanges 74, 43 welded around them, by means of a removable attachment device comprising clevis blocks 75 borne by the peripheral wall of the body of the burner and each comprising a pivot 76 about which is articulated a threaded shank 77 designed to be housed in corresponding facing cut-outs in the peripheral region of the two flanges 74, 43 right through which it passes, and which is locked by a nut 78.

By virtue of this arrangement, the body of the burner is mounted on the charging unit quickly by means of the attachment device 8, because all that is required is for the attachment elements 81 to be installed over the projection with shoulders 64, 65 and for the flange 72 to be attached to it by means of the nuts 84; the tube 4 can then be mounted in the body of the burner easily by bringing its flange 43 up to face the flange 74 of the body of the burner and by tightening the nuts 78 around the threaded shanks 77 once the shanks have been pivoted into the cut-outs in the two flanges.

With the burner mounted in this way, on the one hand, the mist from the injector consists mainly of droplets which are finer than were produced using injectors of the prior art, and which are also entrained at lower speed, something which encourages combustion of heavy fuel oils and, on the other hand, the flame is more stable in the region of the charging opening.

What is claimed is:

1. Fuel injector for an oil burner, internally comprising a duct through which a fuel in the liquid state at least partially in the form of a film lining the internal wall of the duct and an atomizing fluid is introduced into said duct of the fuel injector and are transmitted to the downstream part of the injector which terminates at the free end thereof through which the fuel is sprayed from the injector forming a mist with the stream of atomizing fluid, wherein the this downstream part has internally, in longitudinal alignment with the duct, and in succession towards the free end, a chamber for destabilizing the film which has a cross section that is larger than that of the duct, a throat for detaching the film extending the destabilization chamber and having a cross section that is smaller than that of the chamber, and a spray orifice which is open at the free end of the injector, into which the detachment throat opens, and which has a cross section that is larger than that of the throat.

2. Fuel injector according to claim 1, characterized in that the detachment throat (33) has a cross section that is smaller than that of the duct (31).

3. Fuel injector according to claim 1, characterized in that the destabilization chamber (32) has a circular cross section, the diameter (D2) of which is greater approximately by half than the diameter (D1) of the duct (31), which is also of circular cross section.

4. Fuel injector according to claim 1, characterized in that the destabilization chamber (32) has a circular cross section, and its length (L1) is approximately three times its diameter (D2).

5. Fuel injector according to claim 1, characterized in that the detachment throat (33) has a circular cross section, and its length (L2) is smaller than its diameter (D3).

6. Fuel injector according to claim 1, characterized in that the detachment throat (33) has a circular cross section, and its length (L2) is greater than one quarter of its diameter (D3).

7. Fuel injector according to claim 1, characterized in that the spray orifice (34) has a circular cross section, and its length (L3) is at most equal to the diameter (D3) of the throat (33).

8. Fuel injector according to claim 1, characterized in that the spray orifice (34) has a circular cross section, and its length (L3) is at least equal to half the diameter (D3) of the throat (33).

9. Fuel injector according to claim 1, characterized in that the spray orifice (34) has a circular cross section, and its diameter (D4) is greater approximately by half than the diameter (D3) of the detachment throat (33), which is also of circular cross section.

10. Fuel injector according to claim 1, characterized in that the spray orifice (34) is surrounded by an annular partition, the outside diameter (D5) of which is approximately 1 mm greater than the inside diameter (D4).

11. Fuel injector according to claim 1, characterized in that the said downstream part is made of metal.

12. Fuel injector according to claim 1, characterized in that it is entirely made of metal.

* * * * *